US005758534A

United States Patent [19]

Peyron et al.

[11] Patent Number: 5,758,534

[45] Date of Patent: Jun. 2, 1998

[54] LEVELING MACHINE WITH A PARALLEL CYLINDERS

[75] Inventors: Jean-Baptiste Peyron, Saint-Priest-EN-Jarez; Félix Carchi, Saint-Paul-EN-Jarez, both of France

[73] Assignee: Kvaerner Clecim, Cedex, France

[21] Appl. No.: 723,057

[22] Filed: Oct. 3, 1996

[30] Foreign Application Priority Data

Oct. 6, 1995 [FR] France ..... 95 11822

[51] Int. Cl.[6] ..... B21D 1/02

[52] U.S. Cl. ..... 72/165

[58] Field of Search ..... 72/164, 165, 160

[56] References Cited

U.S. PATENT DOCUMENTS 4,454,738 6/1984 Buta ..... 72/164
4,730,472 3/1988 Ellis ..... 72/164

FOREIGN PATENT DOCUMENTS 0035009 9/1981 European Pat. Off. .
0570770 11/1993 European Pat. Off. .
3437777 4/1986 Germany .

*Primary Examiner*—Daniel C. Crane
*Attorney, Agent, or Firm*—Nikaido, Marmelstein, Murray & Oram LLP

[57] ABSTRACT

A leveling machine with parallel cylinders comprising at least one pair of active leveling cylinders (2), placed on each side of the strip to be leveled and each free to rotate and supported on a crosspiece (5) through a series of spaced bearing members (3). Each bearing member (3) comprises a bearing part (31) mounted in an individual frame forming a casing, connected to crosspiece (5) with a possibility of a clearance transverse to the plane of motion P of strip (A). Each of the said casings bears individually on crosspiece (5) through a positioning member (6) of variable length, for individual adjustment at the level of the corresponding bearing part (31) with respect to the crosspiece (5). The invention is particularly applicable to leveling of thin metal strips.

19 Claims, 4 Drawing Sheets

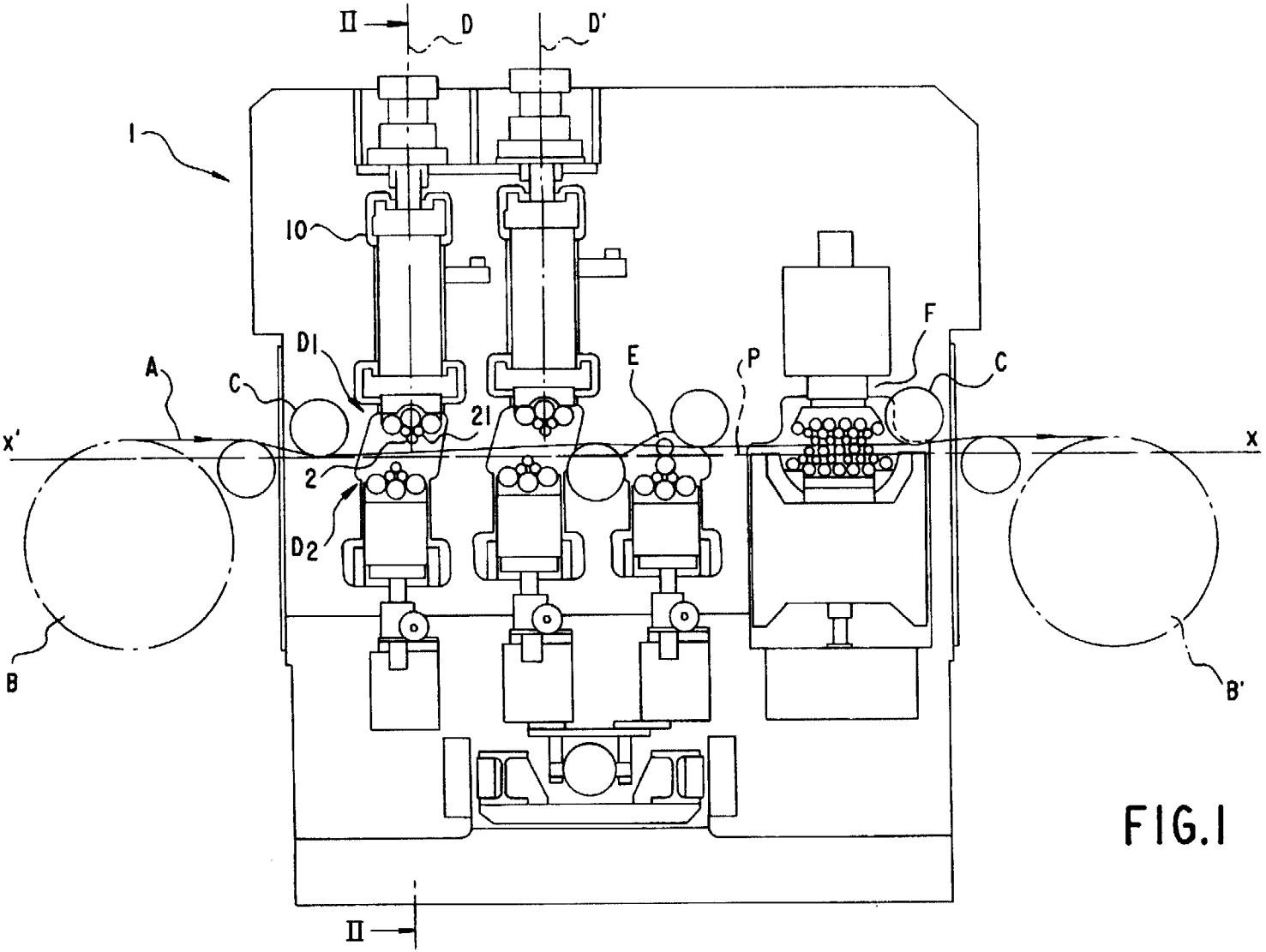
FIG. I

LEVELING MACHINE WITH A PARALLEL CYLINDERS

This invention relates to a leveling machine with parallel cylinders for a strip product.

BACKGROUND OF THE INVENTION

In order to improve the mechanical properties and the planeness of rolled metal strips, in metallurgy it is usual to use different types of leveling machines usually comprising means of pulling the strip to be leveled under tension between at least two cylinders rotating about axes perpendicular to a median plane of motion of the strip, and offset in height to define an undulating path. Thus the strip under tension is subjected to alternating bending of adjustable intensity enabling leveling or the improvement of some characteristics.

The assembly is placed inside a fixed frame in the shape of a cage with two uprights on which at least two bending units bear each carrying a leveling mechanism comprising a mounted leveling cylinder bearing on a resistant cross-piece extending transversely between the cage uprights, and capable of rotation, usually through spaced bearing members distributed along the length of the cylinder, for example rollers mounted to rotate about axes parallel to the cylinder axis.

Normally the strip advances along a direction approximately horizontally and the machine is equipped with one or two pairs of leveling mechanisms (lower and upper) respectively placed on each side on the strip. Furthermore, usually the installation also comprises flexing units called "anti-ripple" and straightening units.

In some configurations, a multi-roller assembly is used for the straightening, said assembly comprising two series of nested rollers with parallel axes between which the strip is passed along an undulating path.

This type of installation has been known for a long time and may be made in different forms, but in general the basic principles remain the same.

In leveling cages used up to now, planeness defects located in the transverse direction may be generated under some conditions. This type of defect may be due to rolling conditions, or may be due to the machine itself, particularly due to the inevitable deformations of the various members that determine the differences in the radii of curvature of undulations followed by the various strip fibers during motion, in the transverse direction.

In particular, unless the machine weight and obviously its price are increased considerably, it is impossible to avoid bending of the crosspiece on which bears each leveling mechanism and which extends between the two cage uprights, the lower face of the cross piece which provides a reference face for the leveling mechanism being not liable to be kept perfectly plane.

Some arrangements have been designed to compensate for these deformations, and in particular for bending of the crosspiece. For example, EP-A-0577170 discloses an installation in which the entire leveling mechanism consisting of the active cylinder and the associated bearing rollers is mounted on a beam-shaped frame extending between the two cage uprights and bearing on the cross piece, on the one bend on limit stops at the level of the uprights, and on the other bend between the uprights through flat jacks that allow adjustment of the distribution of thrust forces along the length of the crosspiece to compensate for deformations in the crosspiece.

However, the observed defects may have other causes, and for example may originate from a transverse heterogeneity in the strip, for example relating to the profile, the elastic limit or the temperature and which may cause stress differences and consequently differences in the elastic backwards of the different longitudinal fibers when passing through the leveling machine.

SUMMARY OF THE INVENTION

Therefore the aim of the invention is to solve this type of problem and to prevent the formation of such defects by means of a much more efficient correction device than known devices and which in particular can precisely distribute the compensation effect along the length of each leveling cylinder in order to very precisely correct all type of defects detected on the strip or predicted by calculations, for example by means of a model.

Therefore the invention is generally applicable to a leveling machine with parallel cylinders of the type comprising inside a fixed frame in the form of a cage with two separated uprights, at least one pair of leveling mechanisms the upper mechanism and the lower mechanism respectively placed on each side of the strip each comprising an active leveling cylinder mounted to rotate about an axis perpendicular to the direction of motion of the strip and bearing while liable of rotation on a series of separated bearing members distributed along the length of the cylinder, and themselves bearing on the side opposite to the cylinder on a resistant crosspiece extending transversely between the cage uprights.

In accordance with the invention, each bearing member comprises a rotary support part mounted in an individual frame forming a casing, connected to the crosspiece with a possibility of clearance transversally to the plane of motion. Each of said casings bears individually on the crosspiece through a positioning member with variable length for individual adjustment of the level of the corresponding support part with respect to the crosspiece.

Preferably, the positioning device associated with each bearing member is a hydraulic, pneumatic or mechanical jack type actuator comprising a first element fixed on the crosspiece and a second element sliding perpendicular to the average plane of motion and having a face in contact with the casing of the bearing member, the actuator being associated with means of adjusting the relative position of the second element with respect to the first.

On the other hand, the casing on each bearing member is kept in contact with the crosspiece through a backwards means towards the crosspiece allowing a small displacement of the bearing member on the opposite side, under the action of the positioning member.

Thus, the casing of each bearing member may be connected to the crosspiece through at least two suspension rods with the possibility of a clearance with respect to the crosspiece, each rod being provided with a backwards elastic stop of the casing toward the crosspiece, with sliding along the rods.

Each bearing member normally comprises two or three separated support rollers mounted to rotate on the casing about an axis parallel to the axis of the leveling cylinder and preferably associated with two intermediate rollers inserted between the leveling cylinder and said rollers.

Advantageously the casings of the bearing members corresponding to the same leveling cylinder are fixed with a clearance on a support frame kept in contact during work on the crosspiece, the frame being provided with a series of holes formed respectively adjacent to each casing to allow the passage of the mobile element of the actuator associated with the casing and bearing on the crosspiece.

Furthermore, an intermediate part may be inserted between the mobile element of each actuator and the casing of the corresponding bearing element, the intermediate part being mounted sliding in the corresponding hole of the support frame perpendicularly to the axis of the cylinder, in order to form a piston actuated by the positioning member.

According to another suitable feature, each leveling cylinder is mounted to rotate on two bearings each supported by a fixed support on the frame, said latter thus supporting the entire leveling mechanism comprising the leveling cylinder, eventually one or several intermediate rollers and the bearing members, and forming a removable cassette mounted on the crosspiece with the possibility of movement parallel to the axis of the cylinder to remove or install the leveling mechanism.

Preferably, the support frame comprises a plate parallel to a crosspiece application face and provided with a series of holes housing platelets with approximately the same thickness than the support plate and each forming a piston. Furthermore, the support plate may advantageously be suspended by at least one pair of rollers rolling on two rails provided along the crosspiece parallel to the axis of the leveling cylinder, such that the cassette can be removed by rolling on said rails.

By means of these arrangements, which allow direction action on the position of the support rollers for each active cylinder, the profile of the active cylinder can be adjusted without the risk of interference from the other bearing members.

But other advantageous features which will be described in the sub-claims will become clear while reading the following specification relating to a specific embodiment given as an example and shown on the appended drawings.

BRIEF DESCRIPTION OF THE DRAWINGS

FIG. 1 shows a schematic view of a longitudinal section through a leveling machine equipped with assemblies according to the invention.

DETAILED DESCRIPTION OF THE PREFERRED EMBODIMENT

FIG. 1 shows a complete leveling mechanism placed in a cage 1 with two separate uprights, conventionally consisting of two parallel walls 11, 12 in which openings 10 are provided with a suitable shape to allow the withdrawal of bending units as will be seen later.

The metal strip A to be rolled advances along a median longitudinal plane P1 from an upstream coil B to a downstream coil B', passing on deflector rollers C which define an average motion plane P which is approximately horizontal.

In the example shown, the installation comprises two successive leveling mechanisms D, D', each consisting of a pair of bending units D1, D2 placed above and below the strip respectively, an anti-ripple device E and a straightening device F which is advantageously made of a multi-roller type machine of a known type.

Figure 2A:
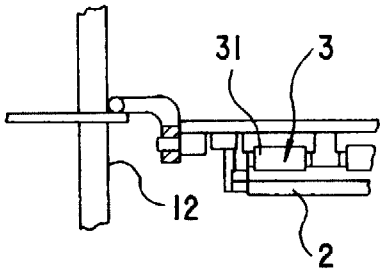
FIG. 2A is a detailed view showing the leveling mechanism in the withdrawn position.
Figure 2:
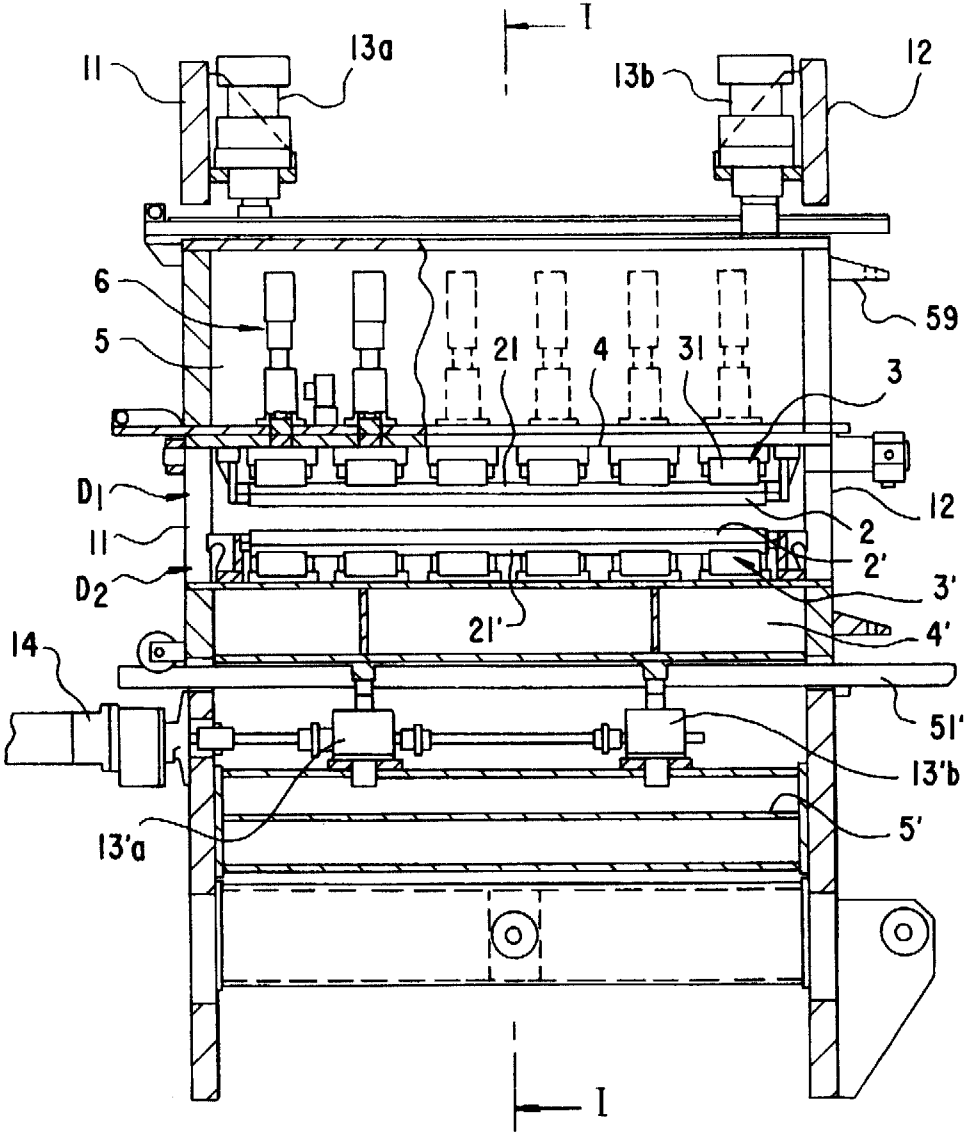
FIG. 2 is a cross-sectional view of a pair of superimposed leveling mechanisms.

FIG. 2 diagramatically shows a cross-section through to the axis of motion of a leveling mechanism comprising an upper bending part D1 and a lower bending part D2. Each bending part has a leveling mechanism composed of an active cylinder 2 bearing through two separated intermediate rollers 21 of the same length on a series of bearing members 3 separated from each other and distributed between the two cage uprights 11 and 12 along the entire length of the active cylinder 2.

Also conventionally, each bearing member 3 is made of several rollers 31, each of which rotates about an axis parallel to the axes of the active cylinder 2 and the intermediate rollers 21.

The entire leveling mechanism is supported on a frame 4 which bears on a beam-shaped crosspiece 5, the ends of which are inserted in recesses 10 in the two uprights 11 and 12 and which bears on two jacks 13*a*, 13*b* fixed on said uprights 11, 12, and which resist to the vertical lifting forces applied by strip A on cylinder 2 during leveling.

The lower bending unit D2 comprises a lower leveling mechanism comprising of an active cylinder 2' bearing through rollers 21' and rollers 3' onto a transverse frame 4', which in the example shown itself bears on a base 5' through two mechanical jacks 13'*a*, 13'*b* used to adjust the level of the frame 4' and the associated leveling mechanism. Normally jacks 13'*a*, 13'*b* are mechanical screw jacks driven in synchronism by a motor 14.

In the example shown on the drawings, the upper jacks 13*a*, 13*b* apply the upper leveling mechanism D1 on limit stops 16 provided on uprights 11, 12 and which therefore give the level of the upper active cylinder 2. On the other hand, the level of the lower active cylinder 2' with respect to the upper cylinder 2 may be adjusted by lower jacks 13'*a*, 13'*b* supporting the lower frame 4'. These jacks are preferably mechanical, to define a constant level during work and capable of precisely adjusting the bending effects applied to strip A.

Indeed the strip under tension is subjected to two alternate bending movements on the active cylinders 2, 2', offset in height, which tend to move apart bearing on the cage, each through bearing members 3, 3', frame 4, 4', crosspiece 5, 5' and jacks 13, 13'.

However, the level of each cylinder and the straightness of its axis depend on the stiffness and the inevitable deformations of the various members that resist the thrust forces.

The arrangements according to the invention which in the example shown are applied to the upper bending unit D1, provide perfect compensation for bending and deformations of the various members and at the same time act very precisely on the profile of the axis of the active cylinder and the distribution of forces, to correct local defects if necessary.

Figure 3:
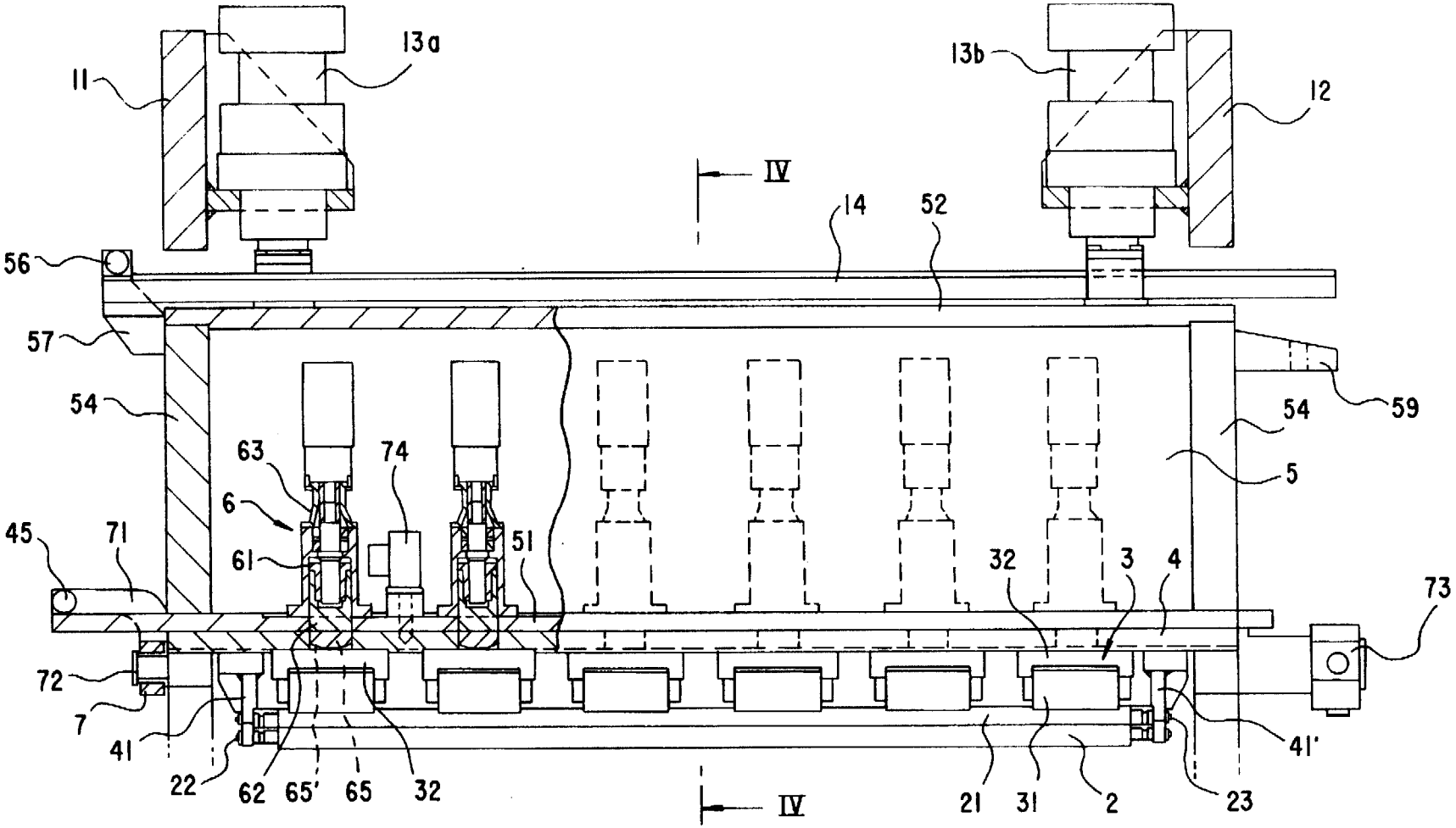
FIG. 3 is a side view at a magnified scale of an upper leveling mechanism, in partial section along line III III.
Figure 4:
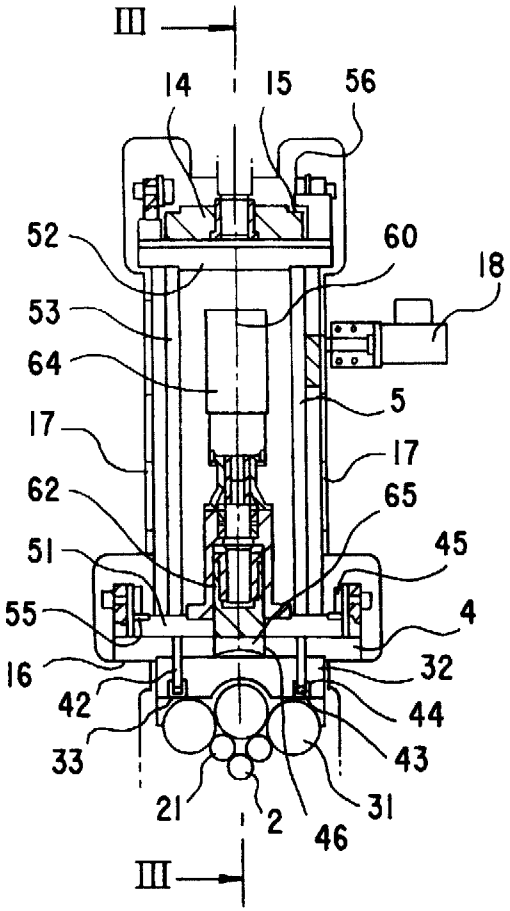
FIG. 4 is a cross-sectional view through to the axis of the cylinders in an upper mechanism in the work position.

As shown on FIG. 2, whereas the bearing members 3' of the lower active cylinder 2' are fixed conventionally on a transverse beam-shaped frame 4' which bears on the adjustment jacks 13', the upper bending unit D1 shown on a larger scale on FIGS. 3 and 4 is made completely differently.

Indeed the entire leveling mechanism support frame 4 is advantageously made of a single relatively thin plate provided with two parts 41, 41' at each end extending downwards, and on which the active cylinder 2 and the intermediate rollers 21 are mounted and are allowed to rotate, through centering bearings 22 and 23 respectively.

In work, this support plate 4 is held in place centered and is applied against the lower face 51 of the crosspiece 5 through a removable locking device 74, to form a single unit with the crosspiece 5 to resist to the applied forces.

The small diameter active cylinder 2 and rollers 21 may deform easily and bear on frame 4 and crosspiece 5 on the side opposite the product, through a number of bearing members 3 each comprising three rollers 31 mounted to rotate about two bearings supported by a casing-shaped frame 32 and defining an axis of rotation of the roller 31 parallel to the axis of the active cylinder 2.

Furthermore, whereas on the lower mechanism D2 the support casings 32 of the rollers 21 are rigidly fixed on the support frame 4, in the case of the upper mechanism Dl, the casings 32 of bearing members 3 are each connected with a clearance to the plate-shaped frame 4 through attachment rods 42 that pass through the bottom of the casing 32. The casing 32 is supported on the heads 43 of rods 42 through elastic stops 44 which thus hold the casing 32 applied in contact with plate 4, in other words towards the crosspiece 5, without preventing small displacements in the opposite direction.

Moreover, as can be seen in FIGS. 3 and 4, each casing 32 is associated with a positioning jack 6 comprising two elements, namely a fixed body 61 and a body on rails 55 provided on each side of the crosspiece 5, with a mobile piston 62 which is positioned with respect to body 61 by an actuator 63.

In the example shown, the jacks are mechanical jacks with clearance compensation, the actuator 63 being a screw rotating about its axis by a motor reduction assembly with encoder 64 which engages in a threaded bore of piston 62 so as to adjust the position of the piston with respect to the body 61.

Furthermore, screw jacks 6 corresponding respectively to the various bearing members 3, are advantageously located inside the crosspiece 5 on which the upper leveling mechanism D1 bears, and which is made of a resistant hollow rectangular box shaped beam limited by a lower face 51, an upper face 52, two side faces 53 and two end faces 54, the bodies 61 of jacks 6 being fixed on the lower face 51 of the beam.

The support plate 4 of the active cylinder 2 and its intermediate rollers 21 extends below the lower face 51 of the crosspiece 5 over its entire length. As described above, in work this plate 4 is applied in contact with the lower face 51 of beam 5, which thus resists to the vertical forces exerted by strip A on the active cylinder 2 during leveling, and is supported on the two uprights of cage 1 through jacks 13*a*, 13*b*.

In the working position shown on FIG. 4, the crosspiece 5 is forced downwards with the entire upper mechanism D1 into contact with the cage stops 16, the ends of plate 4 being inserted between the crosspiece 5 and said stops.

Furthermore, the side walls 53 of the crosspiece 5 are provided with bearing plates 58 that can slide, with almost no clearance, along the sides of the window 10 of cage 1. Thus in the working position shown in FIG. 4, the crosspiece 5 forms a single body with uprights 11 and 12 of cage 1 and may be fixed in this position by a movable locking device 18.

The plate 4 is also provided with a series of holes 46 corresponding to each casing 32 of a bearing member 3 and each centered on the axis 60 of the corresponding jack 6 in the working position which is fixed by the locking device 74. A flat part forming a platelet 65 is inserted inside each hole 46, and placed between the piston 62 of jack 6 and the bottom of casing 32. Preferably, each platelet 65 is equipped on the side of casing 32 with a convex bearing face 65' which provides an approximately point support along the axis of the jack 6, itself centered on the axis of vertical symmetry of casing 32. In this way, each platelet 65 may slide inside a hole 46 in plate 4 under the action of jack 6, to define a slight separation of the casing 32 downwards compressing the elastic stops 44, which are simply used as backwards elastic means of the casing 32 upwards.

Since the platelets 65 slide freely in the holes 46, the relative position of each casing 32 can be adjusted individually with respect to the crosspiece 5 without any deformation of the support plate 4 which is used simply for centering, whereas the end bearings 22 of the active cylinder 2 are kept by the support parts 41, 41' at a constant distance from plate 4 held in contact with the lower face 51 of crosspiece 5 by the leveling force exerted on cylinder 2.

Therefore, by means of the various bearing members 6, it is possible to precisely adjust the profile of cylinder 2 and/or the distribution of stresses in the transverse direction, without interference from the support plate 4 which in work, remains simply forced into contact with the lower face of the crosspiece 5.

Consequently, forces exerted on the active cylinder and consequently on the strip may be much more precise than in previously known arrangements. In particular, the active cylinder 2 may have a straight, concave, convex, or even irregular profile with a series of concave and convex surfaces in order to symmetrically or asymmetrically adapt to all situations and make a precise correction to all types of defects.

By means of the adjustment jacks 6 which may each be associated with an encoder, the check on the deformation of the leveling cylinder and/or applied forces may be done either manually by the operator based on observed or measured results, or automatically for example using a preadjustment system based on an experimental model, or by a system in a closed loop associated with a known type of planeness measurement and checking device.

Note also that the leveling mechanism may be used conventionally for products that do not need any correction. Indeed if jacks 6 hold the pistons 62 in the withdrawn position, all casings 32 of bearing members are brought back to the level of the support plate 4 which is itself kept in contact with the lower face 51 of beam 5 and the assembly may be used as a normal bending unit.

Obviously, the invention is not restricted to the details of the embodiment that has just been described, and alternatives may be imagined without going outside the scope of protection defined by the claims.

In particular in a simplified embodiment, the support plate 4 may form a unit with the crosspiece 5, the assembly forming a cassette mounted to slide horizontally inside the cage, which can thus be withdrawn from the cage as a block, and then replaced inside the cage.

Figure 5:
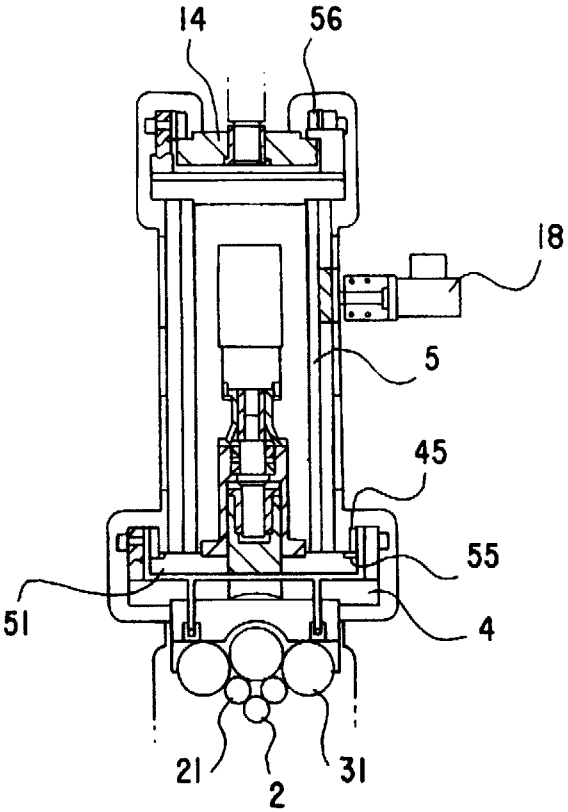
FIG. 5 is a cross-sectional view of an upper mechanism in the cassette withdrawn position.

However, in the preferred arrangement shown in the figures, the support plate 4 is supported by rollers 45 from crosspiece 5 and, together with the leveling mechanism comprising the active cylinder 2 and its bearing members provides a particularly lightweight cassette that can be lifted by jacks 13 in the position shown in FIG. 5 in which the rollers 45 are supported on two rails 55 provided on each side of the crosspiece 5. The plate 4 can then be withdrawn from the cage 1 by axial sliding for maintenance or replacement of the active cylinder 2 and/or bearing members, by rolling on rails 55 until reaching the withdrawn position shown in FIG. 2A. On the other hand, crosspiece 5 remains in position inside the cage with the adjustment jacks 6.

Moreover, it is particularly advantageous to use an arrangement with a rotating cassette as defined by European patent No. 0.446.130.

It is known that drive means in a leveling installation are usually placed on one side of the cage, the operator and the various maintenance devices being placed on the other side.

As shown on FIG. 3, the leveling mechanism support plate 4 is supported on the drive side, in other words on the left in FIG. 3, by a pair of rollers 45 mounted on a suspension device 7 comprising two arms 71 supporting respectively the two rollers 45 and a central body 7 from which the corresponding end of the support plate 4 is suspended through a trunnion 72 with a horizontal axis.

At the opposite end, in other words at the operator side at the right in FIG. 3, the support plate 4 comprises a second trunnion 73 placed along the same line as the opposite trunnion 72 and which bears on a removable support member provided on a disassembly carriage not shown, and similar to that described in European patent No. 0.446.130.

In this way, by sliding on rails 55 parallel to the axis of the leveling cylinder 2, the entire cassette supporting the leveling mechanism can be withdrawn to the position shown on FIG. 2A, and this cassette can be turned over to facilitate replacing or maintenance on the active cylinder and its bearing members which are then facing upwards.

For normal maintenance, the crosspiece 5 remains in position and only plate 4 is withdrawn with the leveling mechanism. This reduction in weight in the mobile and rotating cassette facilitates maneuvers.

After maintenance, the entire cassette is put back into position and plate 4 may be fixed with respect to crosspiece 51 by means of a lock 74 in the position for which holes 46 and platelets 65 are perfectly centered on the axis of pistons 62.

However, for maintenance of jacks 6 placed inside the crosspiece 5, it is preferable to be able to withdraw the crosspiece from the cage. This is why crosspiece 5 is advantageously suspended from a transverse plate 14 extending between the two cage uprights 11 and 12 and fixed on the ends of the rods of the two adjustment jacks 13*a*, 13*b*. The plate 14 on each side of the median plane Pl of crosspiece 5 and of the leveling mechanism is provided with two rails 15 along which rollers 56 rotating above the level of rails 15 are liable to roll.

Crosspiece 5 can thus be suspended from transverse plate 14 by two pairs of rollers 56 supported on arms 57 fixed at each end respectively.

However, in the case in which a cassette disassembly carriage is used as described above, the carriage may also support the crosspiece 5 which is then provided on the drive side with suspension rollers 56, and on the operator side with a removable support means 59 on the disassembly carriage.

With this arrangement, it is possible to remove either the cassette 4 alone from the cage by rolling on the rails 55 of the crosspiece 5, or the assembly consisting of the cassette 4 and the crosspiece 5 by rolling the crosspiece on rails 15 of support 14.

In the first case shown in FIG. 5 which is used for normal maintenance, the crosspiece 5 remains fixed to the cage by the locking device 18, the support plate 4 being suspended from the lower face 51.

In the second case which is used for maintenance of jacks 6, the plate 4 is held applied in contact with the lower face 51 of crosspiece 5, and therefore moves with it.

After withdrawal for maintenance and positioning of the cassette 4 and possibly crosspiece 5, the assembly is forced into contact with the cage stops 16 and held in place by side plates 58 in the working position fixed by locking devices 74 and 18 and for which the crosspiece 5 and the plate 4 form a single piece with cage 1 in order to resist to the vertical forces applied by the strip on the active cylinder 2 during leveling.

In general, in order to correct all detected defects, it is sufficient to use a single leveling mechanism, normally the upper assembly Dl, associated according to the invention with positioning members 6 of bearing members 31.

This is why in the example shown in FIGS. 1 and 2, the lower bending unit D2 is made conventionally, the bearing members 3' of the lower active cylinder 2' being fixed directly to a relatively rigid beam-shaped frame 4' which bears on the base 5' through the mechanical jacks 13'*a*, 13'*b*.

Preferably, these jacks will be removably connected to the support frame 4' which, together with the lower assembly 2', 3' forms an interchangeable cassette that can be withdrawn from the cage by rolling it along lower rails 51'.

However in an even more improved embodiment, it will be possible to make the lower bending unit in a similar way to the upper unit, the support frame then being made of a single plate applied directly to fixed crosspiece 5', the bearing members 3' being mounted in casings positioned such that they can be adjusted individually as described above.

As shown in FIG. 1, a leveling installation could advantageously comprise one or two leveling mechanisms D, D' each comprising an upper bending unit improved according to the invention to camber and/or correct the shape of cylinders, an anti-ripple device E and a multi-roller assembly F. This arrangement could globally solve all leveling problems that may arise in practice, in particular by carrying out the following functions:

- leveling on bending units as made on normal leveling cages, positioning jacks 6 then being retracted;
- cambering and shape correction on upper bending units or only on one of them, in order to prevent the generation of a planeness defect usually related to strip bending and/or transverse heterogeneity problems;
- correction of ripple and bending;
- attenuation of residual internal stresses by the multi-roller assembly.

The assembly may be inspected either by the operator himself directly or by using a preadjustment system, or in a closed loop with a planeness checking system.

Furthermore, in the example embodiment described above, the leveling cylinder is supported conventionally on intermediate rollers and on support rollers. However, the provisions according to the invention could be applied to other support means with the possibility of cylinder rotation, for example by smooth bearing shells.

What we claim is:

1. Leveling machine with parallel cylinders for a strip product moving along a longitudinal direction x'x, in an average motion plane P comprising:

- a fixed frame in the form of a cage having two separate uprights,
- at least one pair of leveling mechanisms including an upper leveling mechanism and a lower leveling mechanism vertically juxtaposed respectively on each side of the strip,
- each leveling mechanism comprising a resistant beam-shaped crosspiece extending transversely between the uprights of the cage, a single active leveling cylinder mounted to rotate about an axis perpendicular to the direction of motion of the strip, and a series of separated bearing members distributed along the length of the cylinder and bearing on a side of the cylinder opposite to the strip and being mounted on said resistant beam-shaped crosspiece, wherein each bearing member comprises a casing connected to the crosspiece, and a rotary bearing part mounted on said casing, said casings of said upper leveling mechanism being movably connected to said crosspiece with a clearance transversely to the plane P of the advancing strip, and each of said casings of said upper leveling mechanism being mounted individually on the crosspiece through a positioning member with variable length for individual adjustment of the level of the corresponding rotary bearing part with respect to the crosspiece.

2. Leveling machine according to claim 1, wherein the positioning member of each bearing member of said upper leveling mechanism includes an actuator comprising a first element fixed on the crosspiece and a second element sliding perpendicularly to the average plane of motion P, and means for adjusting the relative position of the second element with respect to the first element, for adjusting the level of a thrust surface in contact with the casing of the bearing member.

3. Leveling machine according to claim 1, wherein each rotary bearing part comprises at least one support roller mounted to rotate on the casing about an axis parallel to the axis of the leveling cylinder and bearing on the leveling cylinder.

4. Leveling machine according to claim 3, wherein at least one intermediate roller is positioned between the leveling cylinder and the associated support rollers of the bearing members.

5. Leveling machine according to claim 1, further comprising a frame member mounted on said crosspiece, and wherein the casings of the bearing members of said upper leveling mechanism associated with one leveling cylinder are fixed with said clearance onto said frame member, said frame member during operation of the leveling machine kept applied to the crosspiece, said frame member being provided with a series of holes, formed respectively adjacent to each casing to allow the passage of an element of the positioning member with said casing.

6. Leveling machine according to claim 5, wherein each said bearing member of said upper leveling mechanism further comprises an intermediate part inserted between the element of each positioning member and the casing of the corresponding bearing member, said intermediate part being housed in the corresponding hole of the frame member and mounted to slide inside the hole along the axis of the positioning member.

7. Leveling machine according to claim 6, wherein each intermediate part is provided with a convex rounded bearing face in contact with said casing.

8. Leveling machine according to claim 5, wherein the crosspiece comprises a beam having a lower plane face and ends, said frame member being removably attached to said lower plane face and said beam bearing at least at said ends on the two uprights of the cage, said beam forming a hollow box having the positioning members of the bearing member inside.

9. Leveling machine according to claim 8, wherein each positioning member is a jack comprising a first element forming a hollow body fixed on the lower plane face of the crosspiece, and a second element slidably mounted inside said hollow body to form an adjustment piston for the corresponding bearing member.

10. Leveling machine according to claim 9, wherein each jack has a clearance compensation associated with a motor-reduction gear assembly with encoder for adjusting the position of the corresponding bearing member according to the information given by an outside source.

11. Leveling machine according to claim 10, wherein said outside source is an operator.

12. Leveling machine according to claim 10, wherein said outside source is an automatic control system.

13. Leveling machine with parallel cylinders for a strip product moving along a longitudinal direction x'x, in an average motion plane P comprising:

a fixed frame in the form of a cage having two separate uprights, at least one pair of leveling mechanisms including an upper leveling mechanism and a lower leveling mechanism vertically juxtaposed respectively on each side of the strip, each leveling mechanism comprising a resistant beam-shaped crosspiece extending transversely between the uprights of the cage, an active leveling cylinder mounted to rotate about an axis perpendicular to the direction of motion of the strip, and a series of separated bearing members distributed along the length of the cylinder and bearing on a side of the cylinder opposite to the strip and being mounted on said resistant beam-shaped crosspiece, each bearing member comprising a casing connected to the crosspiece, and a rotary bearing part mounted on said casing, said casings of said upper leveling mechanism being movably connected to said crosspiece with a clearance transversely to the plane P of the advancing strip, and each of said casings of said upper leveling mechanism being mounted individually on the crosspiece through a positioning member with variable length for individual adjustment of the level of the corresponding rotary bearing part with respect to the crosspiece;

wherein the casing of each bearing member of said upper leveling mechanism is mounted on the crosspiece through an elastic means biasing said casing towards the crosspiece while allowing a small displacement of the rotary bearing part in an opposite direction under the action of the positioning member.

14. Leveling machine according to claim 13, wherein the casing of each bearing member of said upper leveling mechanism is movably connected to the crosspiece through at least a suspension rod with said clearance relative to the crosspiece, each rod being associated with one said elastic means of the casing.

15. Leveling machine with parallel cylinders for a strip product moving along a longitudinal direction x'x, in an average motion plane P comprising:

a fixed frame in the form of a cage having two separate uprights, at least one pair of leveling mechanisms including an upper leveling mechanism and a lower leveling mechanism vertically juxtaposed respectively on each side of the strip, each leveling mechanism comprising a resistant beam-shaped crosspiece extending transversely between the uprights of the cage, an active leveling cylinder mounted to rotate about an axis perpendicular to the direction of motion of the strip, and a series of separated bearing members distributed along the length of the cylinder and bearing on a side of the cylinder opposite to the strip and being mounted on said resistant beam-shaped crosspiece, each bearing member comprising a casing connected to the crosspiece, and a rotary bearing part mounted on said casing, said casings of said upper leveling mechanism being movably connected to said crosspiece with a clearance transversely to the plane P of the advancing strip, each of said casings of said upper leveling mechanism being mounted individually on the crosspiece through a positioning member with variable length for individual adjustment of the level of the corresponding rotary bearing part with respect to the crosspiece, and a frame member mounted on said crosspiece, wherein the casings of the bearing members of said upper leveling mechanism associated with one leveling cylinder are fixed with said clearance onto said frame member, said frame member during operation of the leveling machine being kept applied to the crosspiece, said frame member being provided with a series of holes, formed respectively adjacent to each casing to allow the passage of an element of the positioning member with said casing: and wherein said frame member has a support at each end thereof, each leveling cylinder being mounted to rotate about two bearings each mounted on one said support fixed on the frame member, said frame member supporting the leveling mechanism and forming a removable cassette mounted on the crosspiece for movement parallel to the axis of the cylinder to remove or install the leveling mechanism.

16. Leveling machine according to claim 15, wherein the frame member comprises a plate removably attached onto a retaining face of the crosspiece and each intermediate part of one bearing member comprises a platelet having a thickness approximately the same as a thickness of the plate, and housed in one said hole of said plate.

17. Leveling machine according to claim 15, wherein two rails are provided along the crosspiece parallel to the leveling cylinder axis, and the frame member is equipped with at least one pair of rollers rolling on said two rails in order to allow the cassette to be removed by rolling on said two rails.

18. Leveling machine with parallel cylinders for a strip product moving along a longitudinal direction x'x, in an average motion plane P comprising:

a fixed frame in the form of a cage having two separate uprights, at least one pair of leveling mechanisms including an upper leveling mechanism and a lower leveling mechanism vertically juxtaposed respectively on each side of the strip, each leveling mechanism comprising a resistant beam-shaped crosspiece extending transversely between the uprights of the cage, an active leveling cylinder mounted to rotate about an axis perpendicular to the direction of motion of the strip, and a series of separated bearing members distributed along the length of the cylinder and bearing on a side of the cylinder opposite to the strip and being mounted on said resistant beam-shaped crosspiece, each bearing member comprising a casing connected to the crosspiece, and a rotary bearing part mounted on said casing, said casings of said upper leveling mechanism being movably connected to said crosspiece with a clearance transversely to the plane P of the advancing strip, and each of said casings of said upper leveling mechanism being mounted individually on the crosspiece through a positioning member with variable length for individual adjustment of the level of the corresponding rotary bearing part with respect to the crosspiece;

wherein each crosspiece is slidably mounted on the two uprights of the cage, transversely to the average plane P of motion of the strip, and said machine further comprises at least one jack mounted on one of said uprights and displacing said crosspiece between a working position and a withdrawn position.

19. Leveling machine according to claim 18, wherein said fixed frame includes two rolling rails and the crosspiece of the upper leveling mechanism is supported in the withdrawn position by at least one pair of rollers supported with clearance on said rolling rails of said fixed frame, the vertical position of said crosspiece being adjusted by said at least one jack, to allow withdrawal of an assembly formed by the crosspiece and the leveling mechanism, and for repositioning it.

* * * * *